US005562220A

United States Patent [19]

Favre

[11] Patent Number: 5,562,220

[45] Date of Patent: Oct. 8, 1996

[54] STOPPER ASSEMBLY OF A BOTTLE OR THE LIKE WITH COMPENSATION OF PLAY

[75] Inventor: Bernard Favre, Chevilly-Larue, France

[73] Assignee: LIR France S.A., Chevilly-Larue, France

[21] Appl. No.: 196,475

[22] Filed: Feb. 15, 1994

[30] Foreign Application Priority Data

Feb. 15, 1993 [FR] France ..... 93 01653

[51] Int. Cl.[6] ..... B65D 41/04

[52] U.S. Cl. ..... 215/331; 215/334; 215/354

[58] Field of Search ..... 215/211, 214, 215/216, 217, 219, 329, 331, 334, 354

[56] References Cited

U.S. PATENT DOCUMENTS

| | | | |
|---|---|---|---|
| 3,249,248 | 5/1966 | Metzendorf et al. | 215/334 |
| 3,422,978 | 1/1969 | Quackenbush | 215/216 |
| 3,658,203 | 4/1972 | Richards . | |
| 3,950,917 | 4/1976 | Choksi et al. | 215/217 X |
| 4,273,247 | 6/1981 | Earls | 215/228 |
| 4,273,248 | 6/1981 | Lehmann | 215/331 |
| 4,597,501 | 7/1986 | Gueret | 215/330 |
| 5,114,029 | 5/1992 | Gibilisco | 215/220 |
| 5,181,624 | 1/1993 | Petit | 215/330 |

FOREIGN PATENT DOCUMENTS

| | | |
|---|---|---|
| 0004501 | 10/1979 | European Pat. Off. . |
| 0005119 | 10/1979 | European Pat. Off. . |
| 2148859 | 6/1985 | United Kingdom . |

*Primary Examiner*—Stephen K. Cronin
*Attorney, Agent, or Firm*—Young & Thompson

[57] ABSTRACT

Stopper assembly having a screw-threaded internal ring (1) for screwing on the neck (16), an external lower ring (7) fixed in rotation with the internal ring (1) but free in translation, the internal ring (1) being provided with resilient tongues (5) bearing on the external lower ring (7), and a cap (8) movable in translation relative to the internal ring (1).

6 Claims, 2 Drawing Sheets

4
8
15
9
12
7
13
5
16
5
3
2
1
8
10
11
12
17

8
3
4
1
14
6
2
6
7

6
14
7
13
12
5
3

8
21
20
24
22
23
25
28
26
27
7
17
5
1
15
16

STOPPER ASSEMBLY OF A BOTTLE OR THE LIKE WITH COMPENSATION OF PLAY

FIELD OF THE INVENTION

The invention relates to a stopper assembly of a bottle or the like of the type comprising a cap screwed on the neck of the bottle or the like.

BACKGROUND OF THE INVENTION

A drawback of these stoppers is that, when the cap and the bottle are rigid, it is not possible to absorb the manufacturing play, which is relatively great in the case of glass bottles. Thus, the limit of screwing is fixed by the end of the screw threads of the bottle and of the cap, which must permit an end of screwing before the cap comes into contact with the bottle. As a result, there is an unattractive gap between the base of the cap and the bottle.

This problem of course does not exist when the cap is provided with a deformable skirt which comes to bear against the bottle before the screwing is completed. But such caps with deformable skirt are delicate and costly to manufacture, and have a limited lifetime by use of plastic materials sensitive to oxygen, heat, and light. They moreover have an inelegant appearance.

SUMMARY OF THE INVENTION

The present invention overcomes this problem by means of a new stopper assembly permitting avoiding play or a gap between the cap and the bottle, while keeping an excellent appearance which can even be improved relative to a conventional stopper.

To this end, the stopper assembly according to the invention is characterized in that it comprises an internal screw-threaded ring for screwing on the neck, a lower external ring fixed in rotation to said internal ring but free in translation, said internal ring being provided with resilient tongues bearing on said external lower ring, and a cap movable in translation relative to said internal ring.

The resilient tongues of the internal ring ensure a bearing without play of the external lower ring on the bottle, the cap being applied, directly or indirectly, on the external lower ring by its translation. The external lower ring therefore plays the role of an embellishment absorbing manufacturing play.

It can be provided, according to one embodiment of the invention, that the cap is fixed in rotation with said external lower ring, for example by snapping and coaction by grooves and tongues. In the course of screwing, the internal screw-threaded ring descends on the neck and, as soon as the lower edge of the external lower ring enters into contact with the bottle, the elastic tongues of the internal ring deform while maintaining the external lower ring applied resiliently against the bottle, the cap remaining integral with the embellishment.

It is preferably provided that the elastic tongues of the lower ring comprise a recess coacting with a tongue of the external lower ring.

According to a modification of the invention, the cap is mounted slidably and pivotably on the inner ring and coacts by its base, directly or indirectly, with the upper edge of the external lower ring.

The first modification can be applied particularly to an open neck, by providing that the internal ring is closed at its upper portion, the internal surface of said upper portion comprising preferably a self-sealing fluid-tight plug.

The second modification is particularly useful for a rechargeable spray bottle whose neck is closed by a mounted pump which is uncovered by removal of the cap. It can be provided, in this case, to improve the appearance, that a keeper is mounted swingably on the base of the cap with an internal rib of triangular cross section disposed in an external groove of the cap, which permits ensuring a perfect joint between this keeper and the external lower ring.

BRIEF DESCRIPTION OF THE DRAWINGS

The invention will be better understood from a reading of the description which follows, given with reference to the accompanying drawing, in which.

DESCRIPTION OF THE PREFERRED EMBODIMENTS

Figure 1:
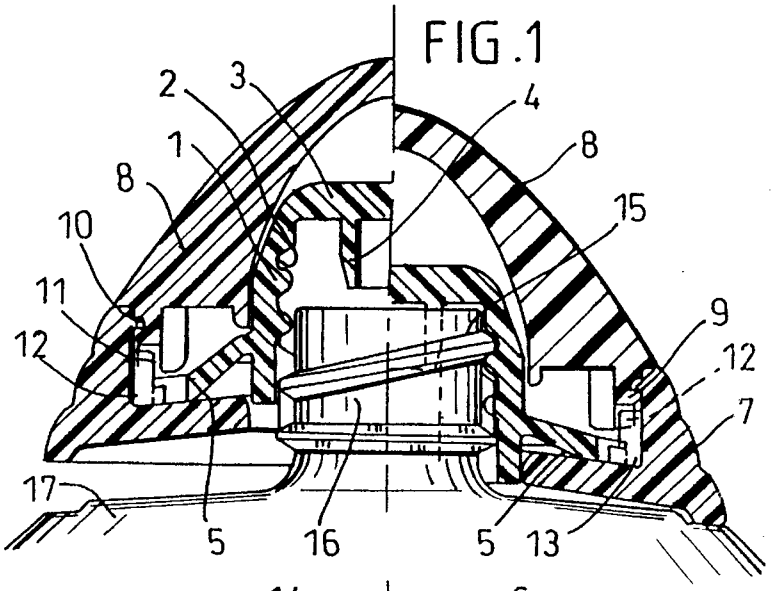
FIG. 1 is a cross-sectional view, partially in elevation, of a stopper assembly according to a first embodiment of the invention, the left portion representing the assembly before screwing and the right portion the assembly after screwing.
Figure 2:
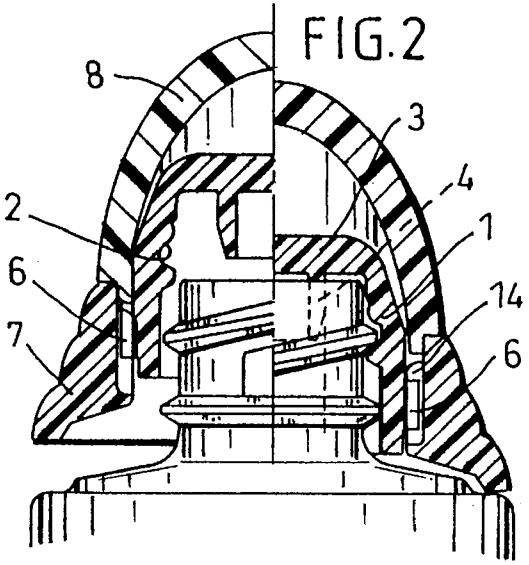
FIG. 2 is analogous to FIG. 1, but at a right angle to FIG. 1.
Figure 3:
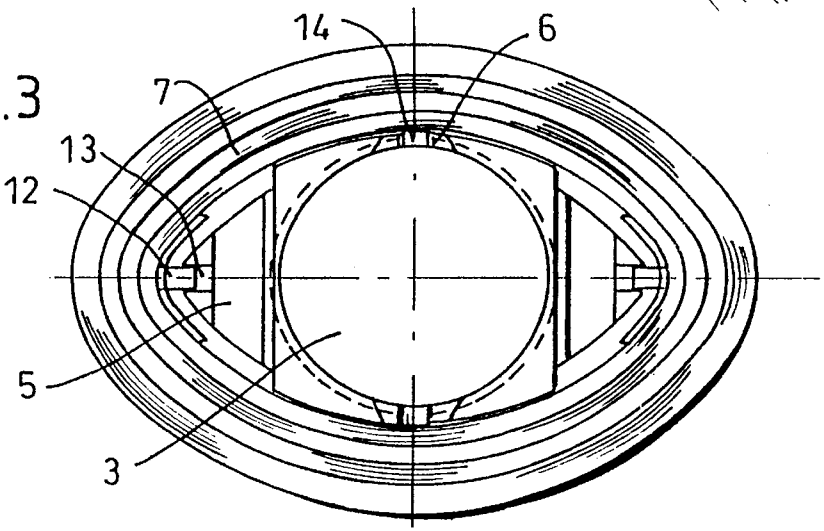
FIG. 3 is a view from above of the assembly of FIG. 1, the cap being removed.

Reference will first be made to FIGS. 1–3 which show a first embodiment. The stopper assembly comprises an internal ring 1 provided with screw threading 2 closed by a cover 3 at its upper end, said cover 3 bearing on its lower face a self-sealing fluid-tight plug 4. The internal ring 1 is provided with two resilient tongues 5 diametrically opposed and outwardly inclined toward the base, as well as two external axial grooves 6 offset by 90° relative to the tongues 5.

An external lower ring 7 forming an embellishment bears a cap 8 snapped on by lugs 9 on lugs 10 of the embellishment 7 and is secured in rotation with the cap 8 by the cooperation of grooves 11 and tongues 12.

The tongues 5 of the internal ring 1 define between them a recess 13 that receives the corresponding tongue 12 of the embellishment 7. The embellishment 7 comprises moreover two tongues 14, disposed at 90° to the tongues 12, and received in the grooves 6 of the internal ring 1.

The internal ring 1 and the embellishment 7, which carries the cap 8, are thus secured in rotation but free for vertical movement relative to each other, the internal ring 1 being thus suspended elastically, by means of the tongues 5, in the block comprised by the embellishment 7 and the cap 8.

During screwing of this assembly on the thread 15 of the neck 16 of a bottle 17, the peripheral edge of the embellishment 7 comes to bear against the bottle 17, the screwing continuing while raising the tongues 5 which comprise the downward portion of the embellishment 7, this latter sliding relative to the internal ring 1. The screwing being if desired limited by a conventional means, the assembly of embellishment 7 and cap 8 is correctly positioned relative to the bottle 17 if these pieces are not figures of revolution. The descent of the cap 8 with the embellishment 7 has caused the self-sealing fluid-tight plug 4 to penetrate the opening of the neck 16 which is thus closed in a sealed manner. The embellishment 7, with the cap 8, being applied under the pressure of the tongues 5 on the bottle 17, no unsightly joint will be present between these members, which permits absorbing the manufacturing tolerances, in particular those of the bottle 17 when it is of glass.

Figure 5:
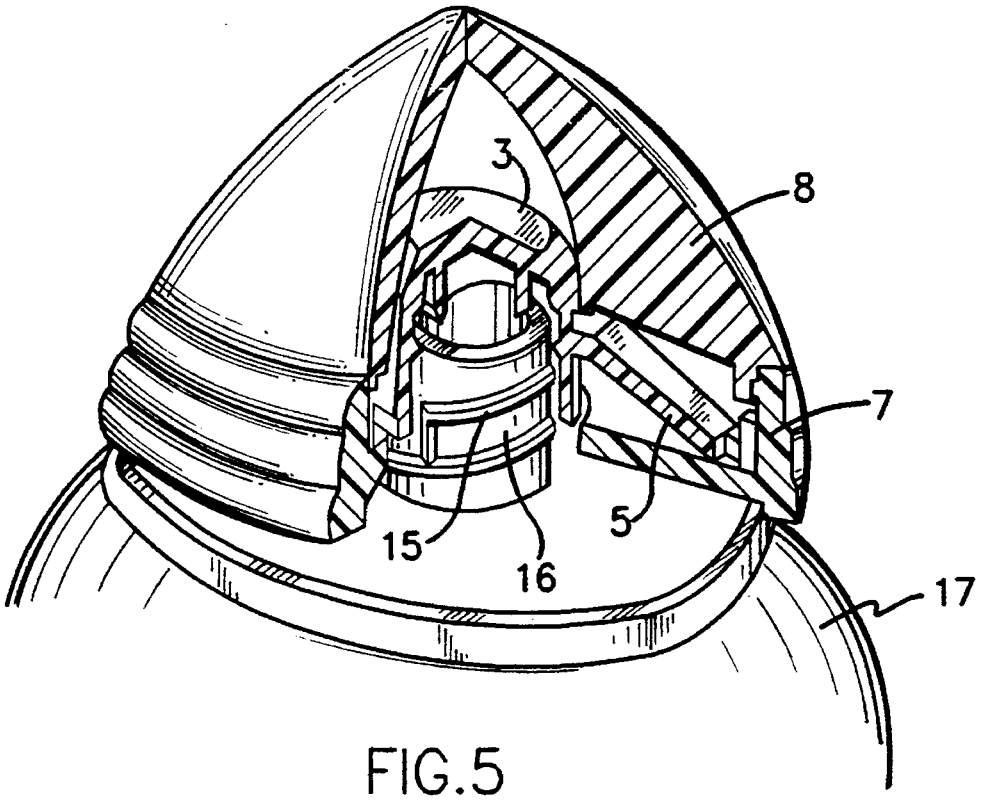
FIG. 5 is a perspective view with parts broken away, showing the parts in the position at the left of FIG. 1.
Figure 6:
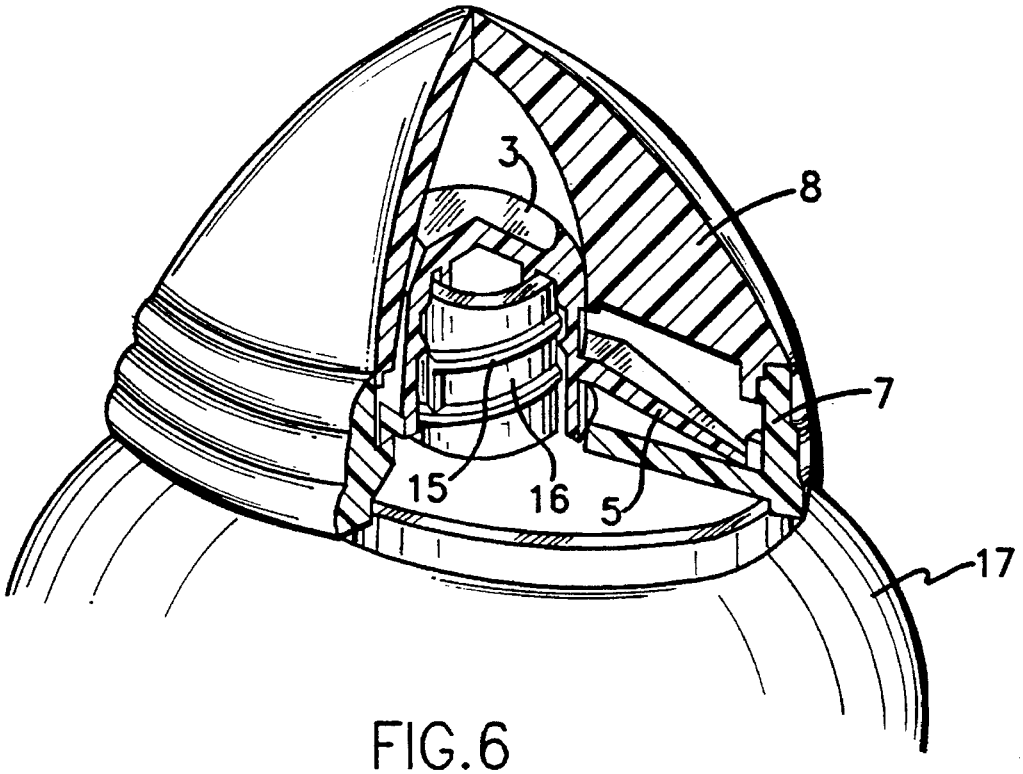
FIG. 6 is a view similar to FIG. 5 but showing the parts in the position shown at the right of FIG. 1.

An initial position of the parts, at the onset of screwing on the cap, is shown at the left of FIG. 1 and in FIG. 5. A final position of the parts, at the end of screwing on the cap, is shown at the right of FIG. 1 and in FIG. 6. It will be understood that the deformation of tongues 5, at the right of FIG. 1 and in FIG. 6, holds the cap 8 against play between the cap and the bottle, and avoids the presence of a gap between the cap and the bottle, as was pointed out above.

Figure 4:
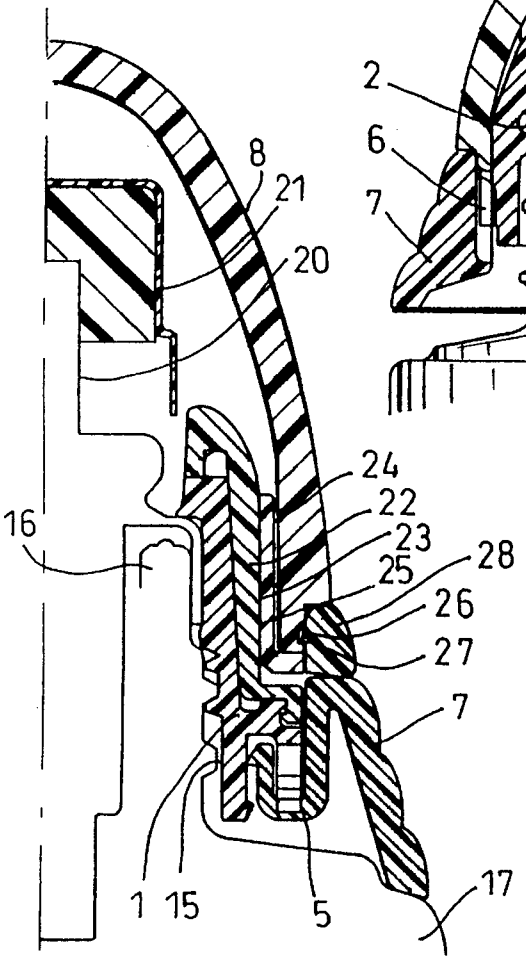
FIG. 4 is a half-section, partially in elevation, of a stopper assembly according to a second embodiment of the invention.

In FIG. 4, the same reference numerals designate the same members as in FIGS. 1 to 3.

The neck of bottle 17 is closed by a pump 20 actuated by a pusher 21. The internal ring 1 locks the pump 20 and bears a clip ring 22 with an external surface 23 which is a cylinder of revolution. The cap 8 comprises an internal ring 24 with an internal surface 25 that is also a cylinder of revolution, such that the cap 8 can slide and pivot on the internal ring 1. The lower edge of the cap 8 comprises also an external peripheral throat 26 in which is disposed a lip 27 of triangular cross section of a keeper 28, such that the keeper 28 can come to bear tightly, by slightly swinging, on the upper edge of embellishment 7.

I claim:

1. Stopper assembly for a bottle having a neck, said stopper assembly comprising a screw-threaded internal ring (1) for screwing on the neck (16), an external lower ring (7) fixed in rotation with the said internal ring (1) but free for vertical movement relative to said internal ring (1), said internal ring (1) being provided with resilient tongues (5) bearing on said external lower ring (7), said resilient tongues deforming upwardly relative to said internal ring (1) when said lower ring (7) contacts the bottle and downward movement of the lower ring (7) is thereafter prevented by the bottle whilst downward movement of the internal ring (1) continues upon continued screwing of the internal ring (1) on the neck (16) of the bottle, and a cap (8) movable with said ring (7) relative to said internal ring (1).

2. Stopper assembly according to claim 1, wherein the cap (8) and the external lower ring (7) have a snapping means, said snapping means including lugs (9) on the cap (8) reciprocating with lugs (10) on the external lower ring (7), the cap further comprising grooves (11), and the external lower ring (7) further comprising tongues (12) coacting with the grooves (11).

3. Stopper assembly according to claim 2, wherein the resilient tongues (5) of the internal ring (1) define a recess (13) receiving a tongue (12) of the external lower ring (7).

4. Stopper assembly according to claim 1, wherein the internal ring (1) has an upper portion comprising an internal surface, said internal ring being closed at said upper portion (3), and said internal surface comprising a self-sealing fluid-tight plug (4).

5. Stopper assembly according to claim 1, wherein the cap (8) has a base secured to an upper edge of the external lower ring (7).

6. Stopper assembly according to claim 5, further including a keeper (28) mounted oscillably on the base of the cap (8) with an internal lip (27) of triangular cross section disposed in an external throat (26) of the cap (8).

* * * * *